US009579537B1

(12) United States Patent
Peng

(10) Patent No.: US 9,579,537 B1
(45) Date of Patent: Feb. 28, 2017

(54) ELLIPTICAL TRAINER WITH CHANGEABLE FOOT MOTION

(71) Applicant: Jing-Yuan Peng, Taipei (TW)

(72) Inventor: Jing-Yuan Peng, Taipei (TW)

(73) Assignee: MARIO CONTENTI DESIGNS CO., LTD., Taichung (TW)

( * ) Notice: Subject to any disclaimer, the term of this patent is extended or adjusted under 35 U.S.C. 154(b) by 0 days.

(21) Appl. No.: 14/964,109

(22) Filed: Dec. 9, 2015

(51) Int. Cl.
*A63B 22/04* (2006.01)
*A63B 22/06* (2006.01)
*A63B 22/00* (2006.01)

(52) U.S. Cl.
CPC ..... *A63B 22/0664* (2013.01); *A63B 22/001* (2013.01)

(58) Field of Classification Search
CPC ..... A63B 21/00058; A63B 21/00069; A63B 21/00076; A63B 21/00192; A63B 21/0056; A63B 21/008; A63B 21/0083; A63B 21/0085; A63B 21/0087; A63B 21/22; A63B 21/225; A63B 21/4033; A63B 21/4034; A63B 21/4045; A63B 21/4047; A63B 21/4049; A63B 22/001; A63B 22/0015; A63B 22/0017; A63B 22/0046; A63B 22/0048; A63B 22/06; A63B 22/0664; A63B 22/0694; A63B 2022/0051; A63B 2022/0053; A63B 2022/0676; A63B 2022/0682; A63B 23/035; A63B 23/03516; A63B 23/03533; A63B 23/03575; A63B 23/04; A63B 23/0405; A63B 23/0423; A63B 23/0429; A63B 23/0482; A63B 23/0494; A63B 23/12; A63B 23/1209; A63B 23/1245; A63B 23/1263; A63B 23/1281; A63B 2023/0441; A63B 2023/0447; A63B 2023/0452; A63B 69/182; A63B 71/0054; A63B 2071/0072; A63B 2208/02; A63B 2208/0204; A63B 2225/09; A63B 2225/093; A63B 2225/096
See application file for complete search history.

(56) References Cited

U.S. PATENT DOCUMENTS 5,792,028 A * 8/1998 Jarvie ..... A63B 22/001 482/51
6,004,244 A * 12/1999 Simonson ..... A63B 21/153 482/51
6,036,622 A * 3/2000 Gordon ..... A63B 21/154 482/51
6,135,923 A * 10/2000 Stearns ..... A63B 22/001 482/51

(Continued)

*Primary Examiner* — Stephen Crow
*Assistant Examiner* — Gary D Urbiel Goldner
(74) *Attorney, Agent, or Firm* — Egbert Law Offices, PLLC

(57) ABSTRACT

An elliptical trainer has a main frame having two opposite sides, each having a linking device, a stepping device and an interlocking device mounted thereon, wherein the interlocking device is provided to connect the linking device and the stepping device. A damping device is mounted on the main frame and operated with the two interlocking devices so as to promote exercise on the elliptical trainer. A longitudinal axis of an elliptical foot motion of each stepping device is adjusted due to a step force from an operator for changing a working stroke of the elliptical trainer.

12 Claims, 9 Drawing Sheets

(56) References Cited

U.S. PATENT DOCUMENTS 6,786,851 B1 * 9/2004 Maresh ..... A63B 22/0664 482/52
7,201,706 B1 * 4/2007 Lee ..... A63B 22/001 482/52
7,462,134 B2 * 12/2008 Lull ..... A63B 22/0015 482/52
7,608,018 B2 * 10/2009 Chuang ..... A63B 22/001 482/52
7,811,206 B2 * 10/2010 Chuang ..... A63B 22/001 482/52
8,303,470 B2 * 11/2012 Stewart ..... A63B 22/001 482/51
8,409,058 B2 * 4/2013 Gordon ..... A61H 1/0237 482/51
9,017,225 B2 * 4/2015 Huang ..... A63B 22/0664 482/51
9,295,874 B1 * 3/2016 Chen ..... A63B 22/0664
9,364,708 B2 * 6/2016 Luger ..... A63B 22/04
2002/0198083 A1 * 12/2002 Goh ..... A63B 22/0012 482/57
2005/0148438 A1 * 7/2005 Carlsen ..... A63B 22/001 482/52
2006/0142122 A1 * 6/2006 Kettler ..... A63B 22/001 482/52
2006/0142123 A1 * 6/2006 Kettler ..... A63B 22/001 482/52
2006/0172862 A1 * 8/2006 Badarneh ..... A63B 22/001 482/52
2007/0015632 A1 * 1/2007 Eschenbach ..... A63B 22/001 482/52
2007/0037667 A1 * 2/2007 Gordon ..... A63B 22/0017 482/51
2007/0042871 A1 * 2/2007 Wu ..... A63B 22/001 482/52
2007/0219061 A1 * 9/2007 Rodgers, Jr. ..... A63B 21/151 482/52
2008/0161164 A1 * 7/2008 Stewart ..... A63B 22/001 482/52
2009/0176624 A1 * 7/2009 Chang ..... A63B 22/001 482/52
2009/0298649 A1 * 12/2009 Dyer ..... A63B 22/001 482/4
2010/0248903 A1 * 9/2010 Cardile ..... A61H 1/0262 482/51
2011/0172061 A1 * 7/2011 Eschenbach ..... A63B 22/0017 482/52
2011/0275485 A1 * 11/2011 Eschenbach ..... A63B 21/00069 482/52
2011/0281689 A1 * 11/2011 Ling ..... A63B 22/0664 482/52
2012/0035023 A1 * 2/2012 Eschenbach ..... A63B 21/00069 482/52
2012/0178589 A1 * 7/2012 Eschenbach ..... A63B 21/00069 482/52
2013/0012363 A1 * 1/2013 Eschenbach ..... A63B 21/00069 482/52
2013/0053218 A1 * 2/2013 Barker ..... G06F 19/3481 482/4
2013/0210578 A1 * 8/2013 Birrell ..... A63B 71/0622 482/4
2014/0051552 A1 * 2/2014 Habing ..... A63B 21/154 482/52
2014/0141939 A1 * 5/2014 Wu ..... A63B 22/001 482/52
2014/0336007 A1 * 11/2014 Miller ..... A63B 22/04 482/52
2015/0335943 A1 * 11/2015 Miller ..... A63B 22/0664 482/52

* cited by examiner

ELLIPTICAL TRAINER WITH CHANGEABLE FOOT MOTION

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an elliptical trainer, and more particularly to an elliptical trainer with changeable foot motion.

2. Description of Related Art Including Information Disclosed Under 37 CFR 1.97 and 37 CFR 1.98

In various exercisers, an elliptical trainer is popular because the elliptical trainer can imitate motions of feet and legs during walking. However, the original elliptical trainer has no adjusting functions such that the motion cannot be adjusted relative to the height and size of users. Furthermore, the original elliptical trainer without adjusting function may cause a sport injury. Consequently, the original elliptical trainer needs to be altered.

A conventional elliptical trainer includes a base and a stem extending from the base. A left linkage structure and a right linkage structure respectively mounted onto two opposite sides of the stem. Each linkage structure includes a step set moved back and forth. An interlocking device is disposed on the stem and connected to the two step sets for providing an elliptical motion to the two step sets. A left adjusting device and a right adjusting device are respectively pivotally mounted onto the stem for adjusting the elliptical motion of each of the two step set.

The conventional elliptical trainer has two adjusting ways for adjusting the elliptical motion of each of the two step set and the two adjusting ways are respectively described as follow.

Hand regulation uses a shaft with multiple through holes and an adjusting set sleeved on the shaft for providing adjusting function, wherein the adjusting set includes a tubular element movably sleeved on the shaft and a locking pin reciprocally movably mounted on the tubular element. The locking pin is selectively inserted into a corresponding one of the through holes for providing the adjusting function. However, this adjusting method cannot provide a stepless adjustment. In addition, the shaft must define more through holes for providing a finer adjustment. However, the more and more through holes will reduce the strength of the shaft.

Electric regulation uses a threaded shaft and a linear slider to provide a stepless adjustment. As well known, a servo motor or a DC motor is necessary for driving the threaded shaft and make the threaded shaft being rotated relative to the slider. However, the servo motor and the DC motor are very expensive elements for the conventional elliptical trainer. An expensive price will reduce the market competitiveness of the conventional elliptical trainers such that the conventional elliptical trainers in accordance with the prior need to be advantageously altered.

The present invention has arisen to mitigate and/or obviate the disadvantages of the conventional elliptical trainers.

BRIEF SUMMARY OF THE INVENTION

The main objective of the present invention is to provide an improved elliptical trainer adjust a length of a long axis of the elliptical foot motion due to the step force from an operator.

To achieve the objective, the elliptical trainer in accordance with the present invention comprises a main frame having two opposite sides each having a linking device, a stepping device and an interlocking device mounted thereon, wherein the interlocking device is provided to connect the linking device and the stepping device. A damping device is mounted on the main frame and operated with the two interlocking devices for promoting the exercise effect of the elliptical trainer. Each interlocking device includes a crank having a first end secured on a corresponding one of the two ends of the axle and a linkage having a middle portion pivotally mounted onto a second end of the crank, wherein the two cranks oppositely extend and linearly correspond to each other. Each linkage has two opposite ends respectively pivotally connected to a corresponding one of the two linking devices and the two stepping devices. The linking device includes a swing linkage laterally pivotally mounted onto the stem. The swing linkage has a first end pivotally connected to a first end of the linkage and a second end pivotally connected to a first end of a first linkage. A second linkage is laterally and pivotally mounted onto the stem, and has a front end and a rear end, wherein the front end of the second linkage is pivotally connected to a second end of the first linkage. A third linkage has an upper end pivotally connected to the rear end of the second linkage and a lower end pivotally connected to the stepping device. The stepping device has a front end and a rear end respectively pivotally connected to a second end of the linkage and the lower end of the third linkage. The stepping device is divided into a front section and a rear section linearly strung together, wherein the front end of the front section is pivotally connected to the second end of the linkage. A pedal is pivotally connected to a rear end of the rear section and the lower end of the third linkage laterally pivotally connected to the pedal. The rear section is reciprocally and longitudinally moved relative to the front section for changing the total length of the stepping device to adjust a length of a long axis of the elliptical foot motion of the elliptical trainer due to the step force from an operator.

Further benefits and advantages of the present invention will become apparent after a careful reading of the detailed description with appropriate reference to the accompanying drawings.

DETAILED DESCRIPTION OF THE INVENTION

Figure 1:
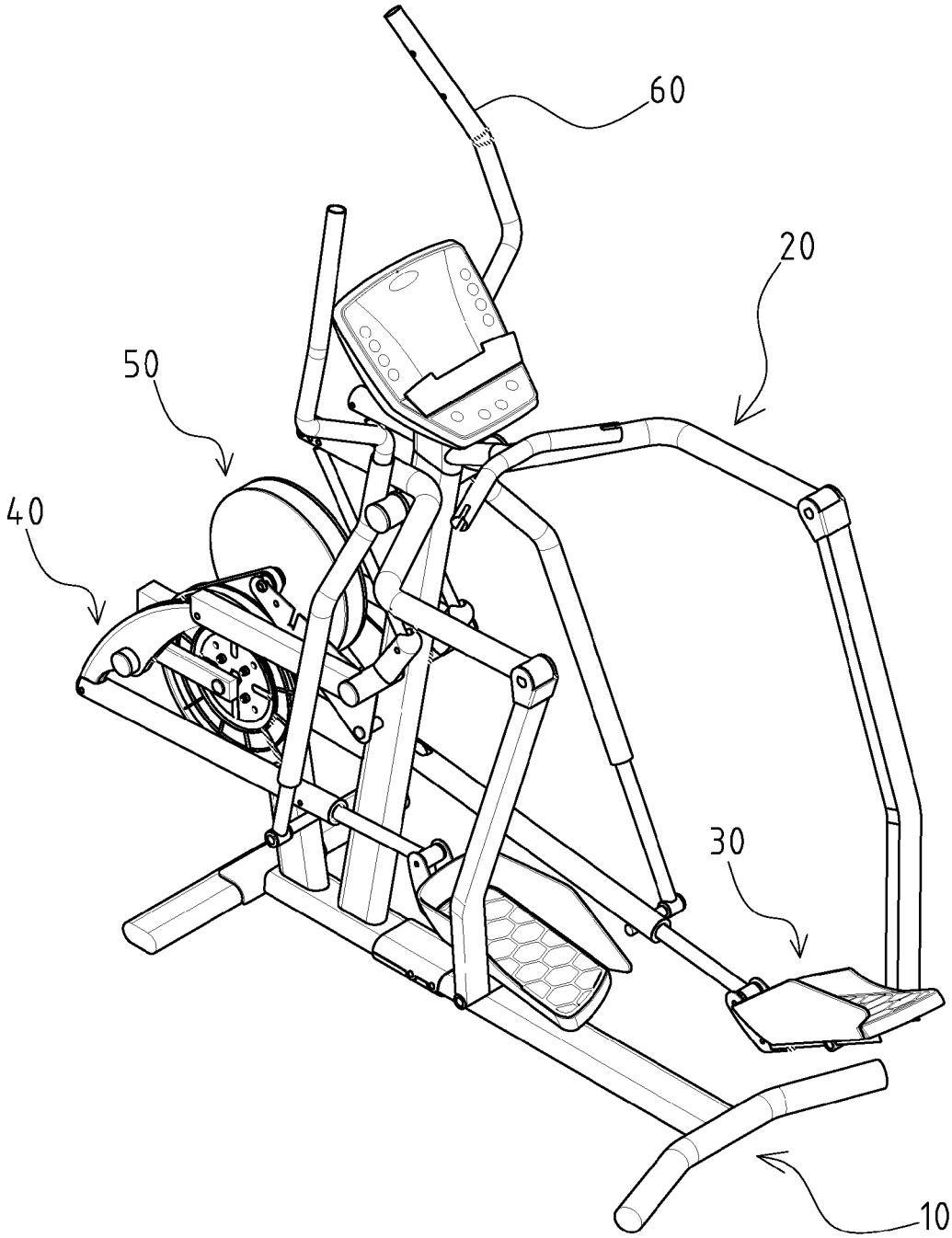
FIG. 1 is a perspective view of an elliptical trainer in accordance with the present invention.
Figure 2:
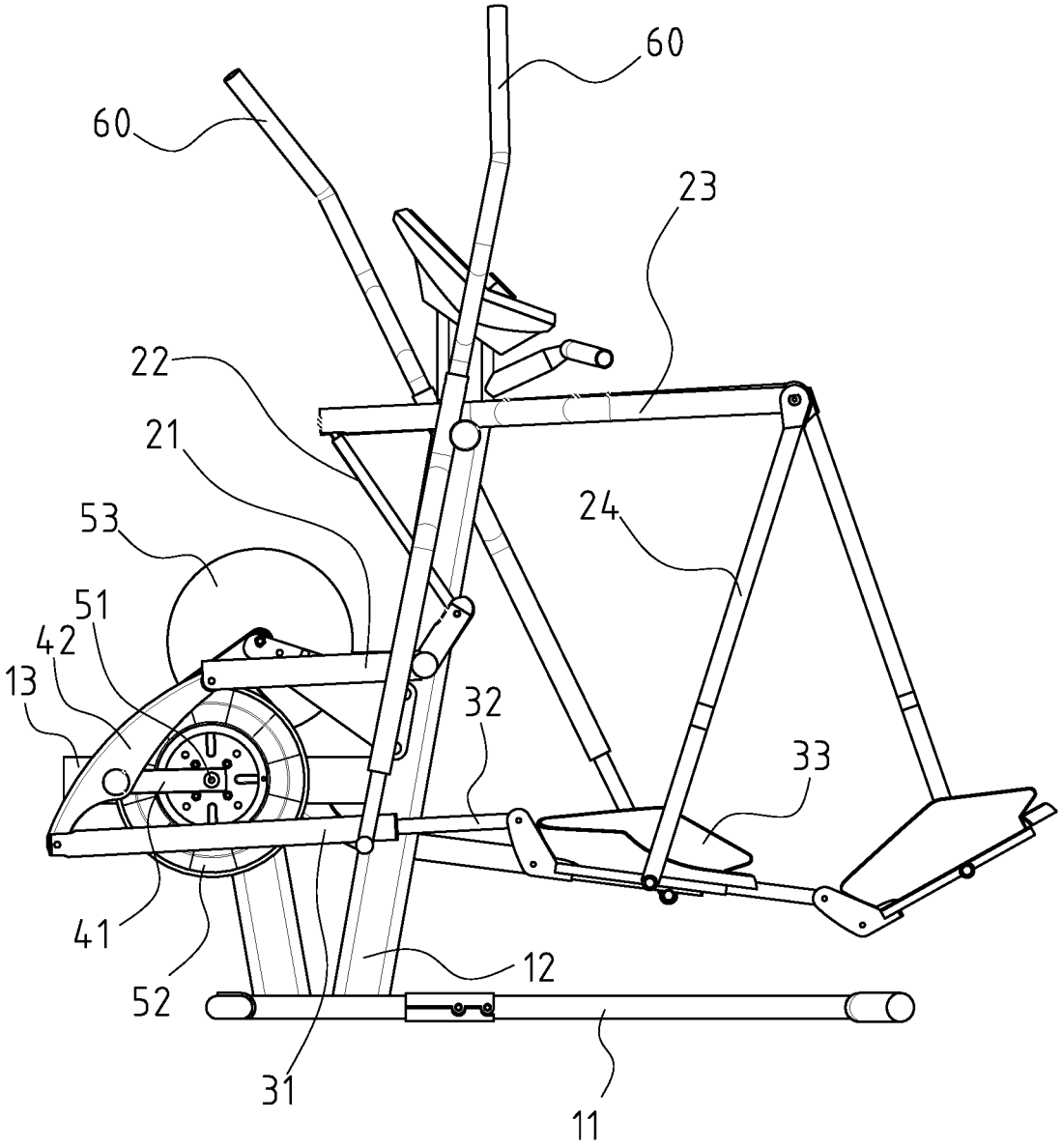
FIG. 2 is a side plan view of the elliptical trainer in FIG. 1.
Figure 3:
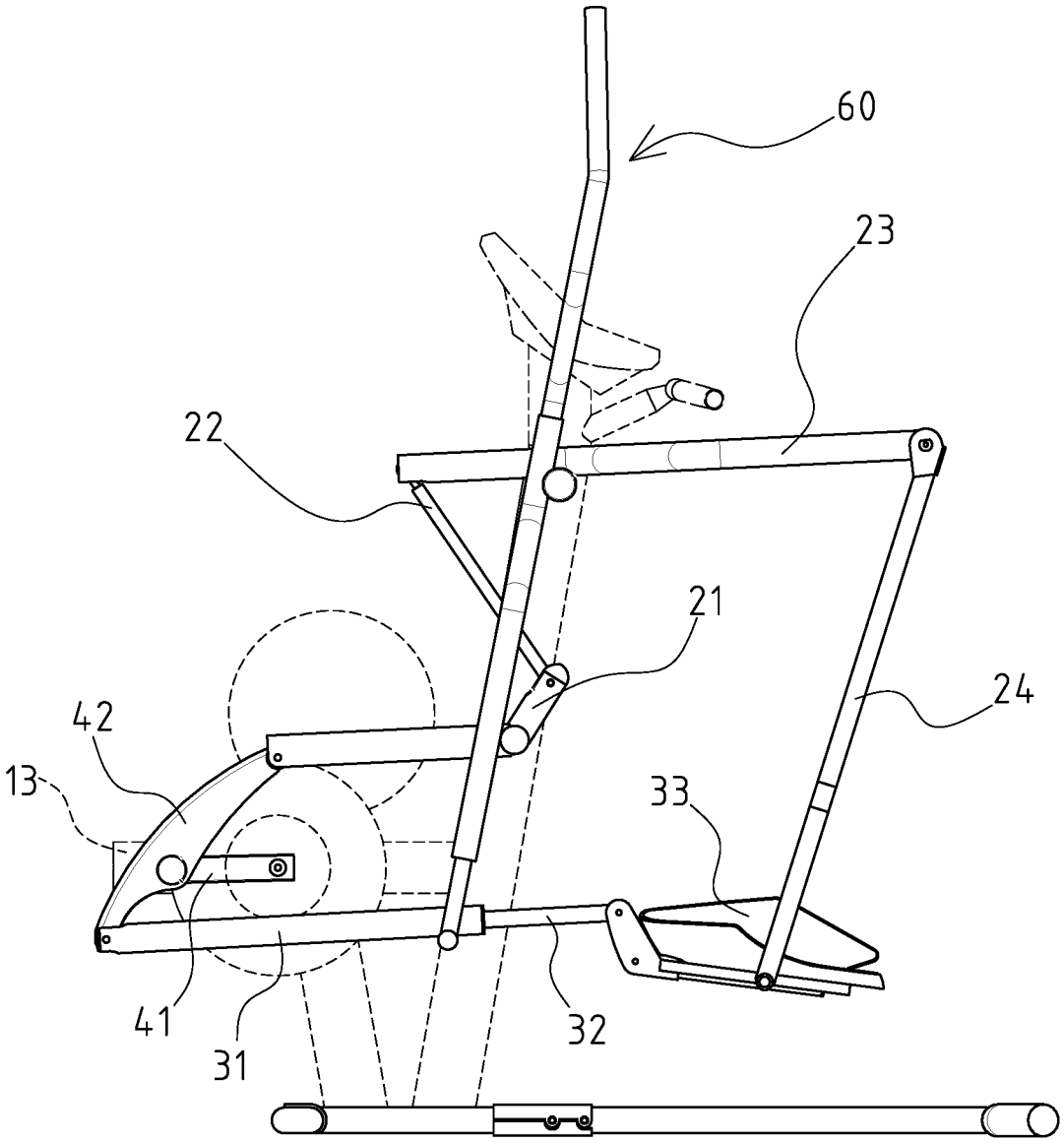
FIG. 3 is a side plan view of the elliptical trainer in FIG. 1 when the pedal is moved to a front end of an original foot motion.

Referring to the drawings and initially to FIGS. 1-3, an elliptical trainer in accordance with the present invention comprises a main frame 10 having two opposite sides each having a linking device 20, a stepping device 30 and an interlocking device 40 mounted thereon wherein the interlocking device 40 is provided to connect the linking device 20 and the stepping device 30. A damping device 50 is mounted on the main frame 10 and operated with the two interlocking devices 40 for promoting the exercise effect of the elliptical trainer. A long axis of the elliptical foot motion of the two stepping device 30 is adjusted due to the step force from the operator for changing the working stroke.

The main frame 10 includes an I-shaped base 11, a stem 12 extending from a front portion of the base 11, and a support 13 connected to the base 11 and the stem 12.

The damping device 50 includes a flywheel 52 rotatably mounted on the support 13 by an axle 51 and a damping wheel 53 rotatably mounted on the support 13, wherein the damping 53 is operated with the flywheel 52 for promoting the exercise effect of the elliptical trainer.

Each interlocking device 40 in includes a crank 41 having a first end secured on a corresponding one of the two ends of the axle 51 and a linkage 42 having a middle portion pivotally mounted onto a second end of the crank 41, wherein the two cranks 41 oppositely extend and linearly correspond to each other. Each linkage 42 has two opposite ends respectively pivotally connected to a corresponding one of the two linking devices 20 and the two stepping devices 30.

The linking device 20 includes a swing linkage 21 laterally pivotally mounted onto the stem 12, wherein the swing linkage 21 is boomerang-shaped and formed with a corner pivotally mounted onto the stem 12. The swing linkage 21 has a first end pivotally connected to a first end of the linkage 42 and a second end pivotally connected to a first end of a first linkage 22. A second linkage 23 is laterally and pivotally mounted onto the stem 12. The second linkage 23 has a front end and a rear end, wherein the front end of the second linkage 23 is pivotally connected to a second end of the first linkage 22 and a third linkage 24 having an upper end pivotally connected to the rear end of the second linkage 23. The third linkage 24 has a lower end pivotally connected to the stepping device 30.

Figure 6:
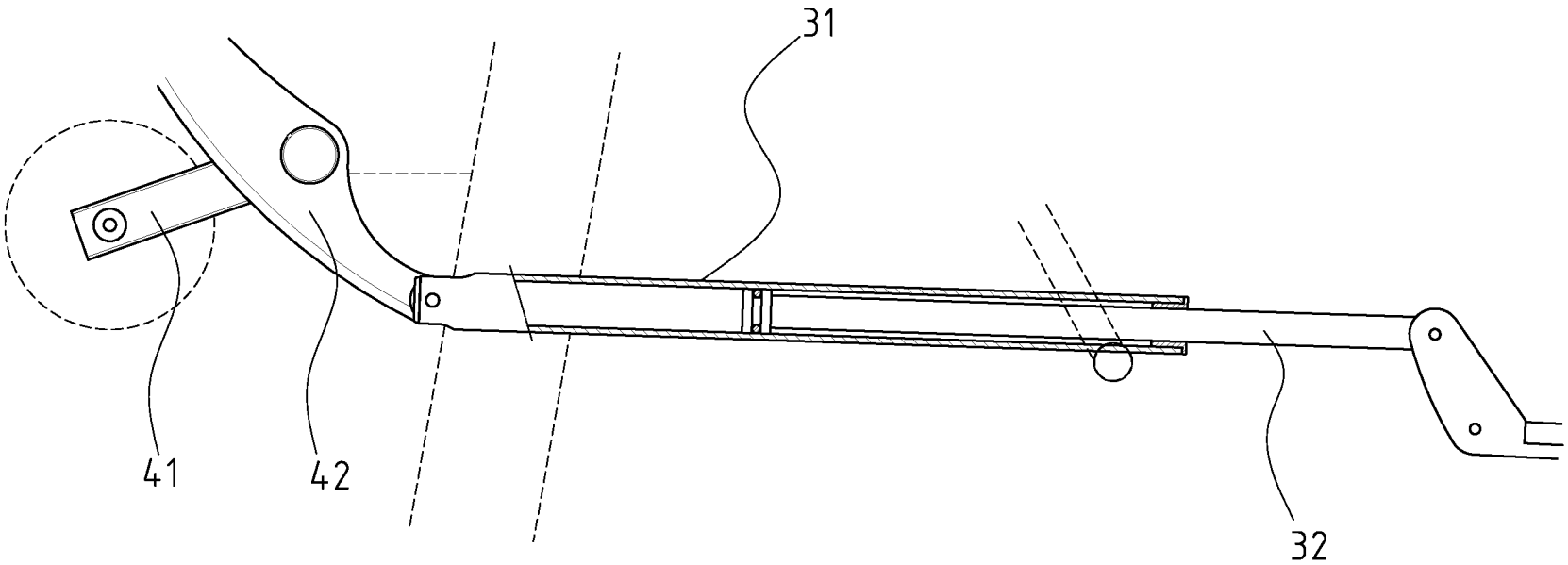
FIG. 6 is a partially cross-sectional view of the stepping device of the elliptical trainer in accordance with the present invention.

The stepping device 30 has a front end and a rear end respectively pivotally connected to a second end of the linkage 42 and the lower end of the third linkage 24. The stepping device 30 is divided into a front section 31 and a rear section 32 linearly strung together, wherein the front end of the front section 31 is pivotally connected to the second end of the linkage 42, a pedal 33 is pivotally connected to a rear end of the rear section 32 and the lower end of the third linkage 24 is laterally pivotally connected to the pedal 33. The rear section 32 is reciprocally and longitudinally moved relative to the front section 31 for changing the total length of the stepping device 30 to adjust the elliptical foot motion of the elliptical trainer and a restitution force is provided between the front section 31 and the rear section 32. With reference to FIG. 6, the front section 31 and the rear section 32 are assembled as a cylinder. In addition, the front section 31 and the rear section 32 are also assembled as a rail and a slider.

The elliptical trainer in accordance with the present invention further includes two handlebars 60 respectively pivotally connected to two opposite sides of the main frame 10. Each handlebar 60 has a lower end pivotally connected to a front end 31 of a corresponding one of the two stepping devices 30 and an upper end for being handled during being operated. The handlebar 60 has an inner tube 61 and an outer tube 62, wherein the inner tube 61 is partially and movably received in the outer tube 62, such that the total length of the handlebar 60 is changed due to the long axis of the elliptical foot motion of the pedal 33.

Figure 4:
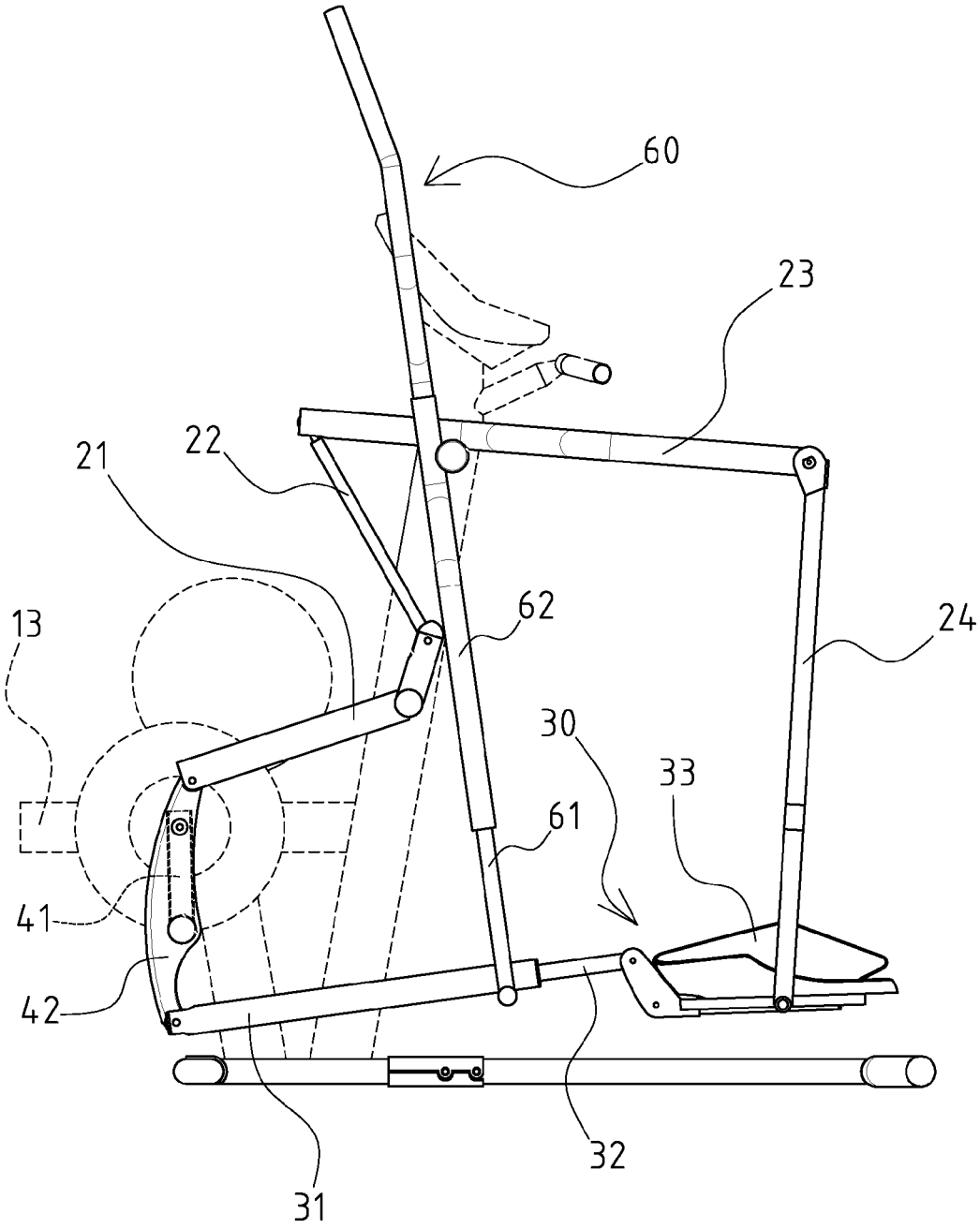
FIG. 4 is a side plan view of the elliptical trainer in FIG. 1 when the pedal is moved to a middle portion of an original foot motion.
Figure 5:
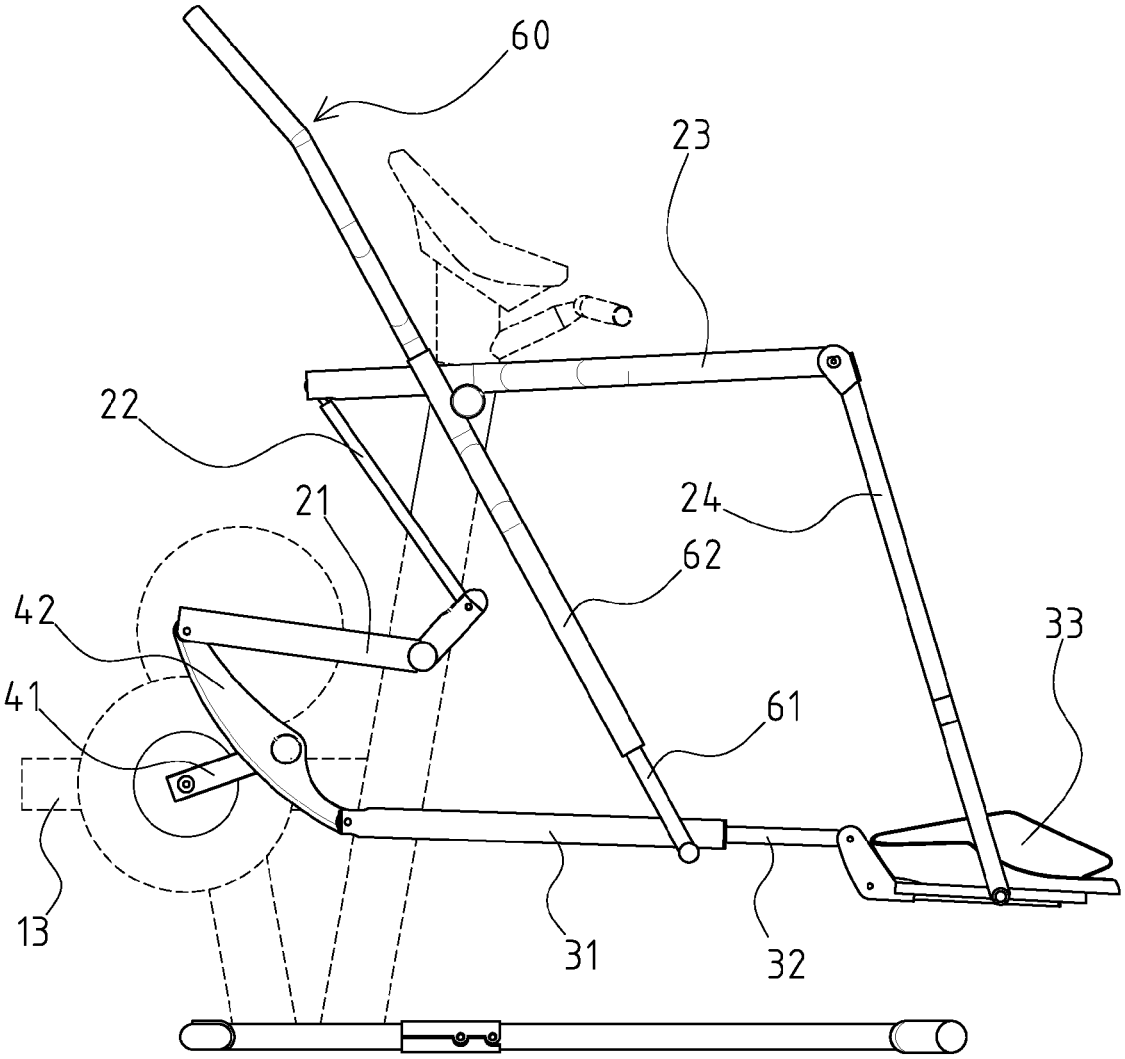
FIG. 5 is a side plan view of the elliptical trainer in FIG. 1 when the pedal is moved to a rear end of an original foot motion.

With reference to FIGS. 4, 5 and 6, driving feature of the elliptical trainer in accordance with the present invention is a six bar linkage mechanism including the stepping device 30, the linkage 42, the swing linkage 21, the first linkage 22, the second linkage 23 and the third linkage 24 pivotally connected to one another for imitating an elliptical walking motion. In addition, the six bar linkage mechanism of the present invention can lengthen a long axis of the elliptical walking motion for enhancing the leg-raising action and training the muscle strength of user's legs.

Figure 7:
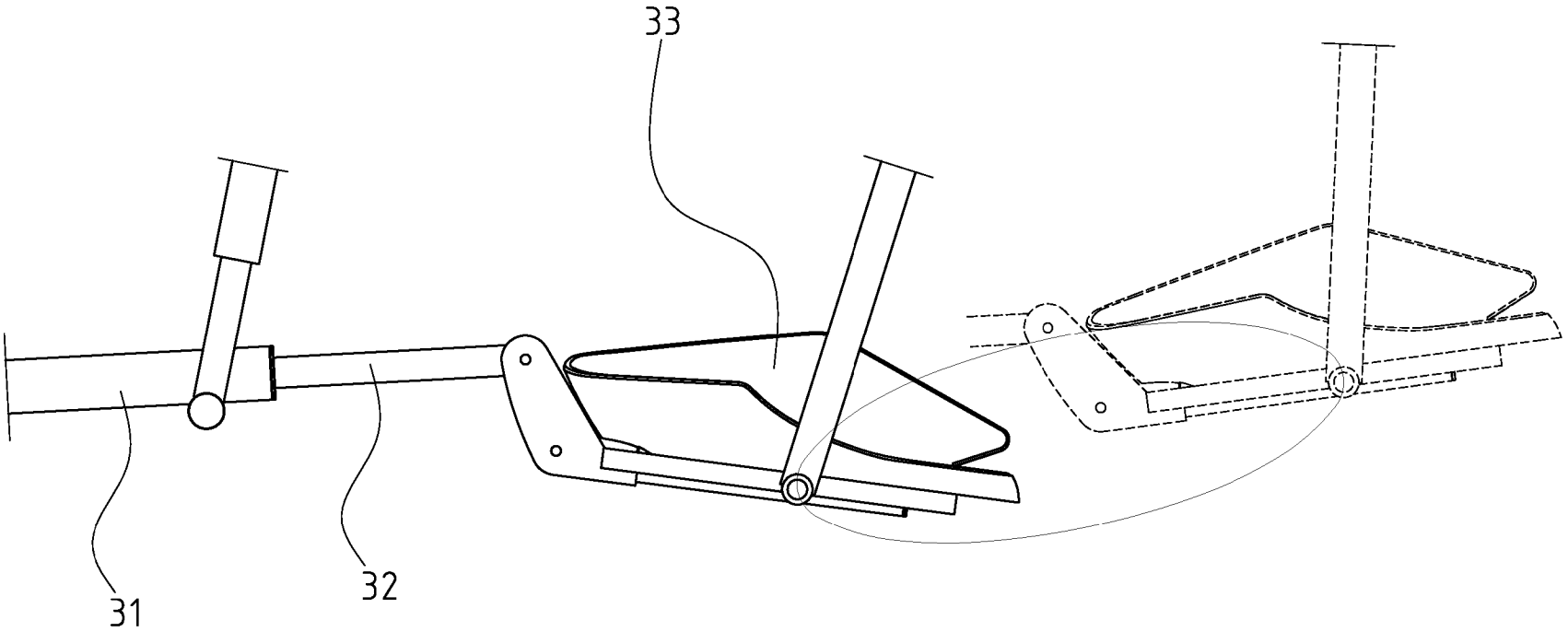
FIG. 7 is a side plan view for showing the original foot motion.
Figure 8:
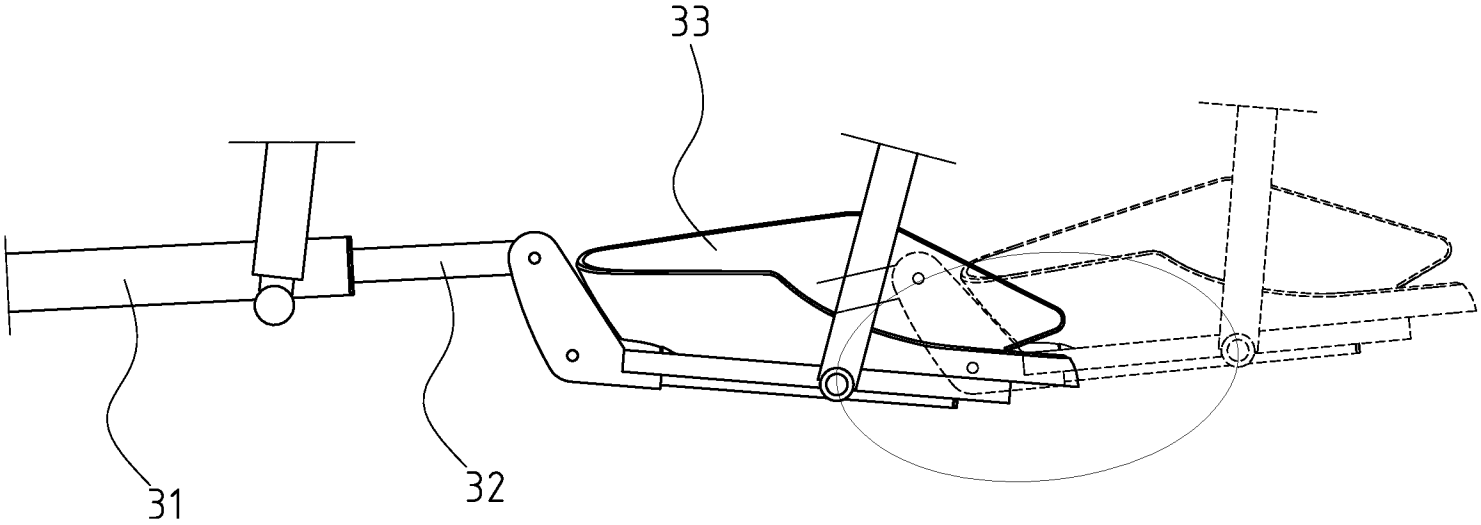
FIG. 8 is a side plan view for showing an adjusted foot motion, wherein the long axis of the original foot motion, as shown in FIG. 7, is shortened.

The difference between the present elliptical trainer and the conventional elliptical trainer is the adjusting mode. The elliptical trainer in accordance with the present invention provides two adjusting modes, including aggressive adjusting mode and passive adjusting mode, to the elliptical trainer user. In the passive adjusting mode: the linkage 42 is disposed between the stepping device 30 and the crank 41 and the operated linkage 42 can lengthen the long axis of the elliptical foot motion of the conventional elliptical trainer. In the aggressive adjusting mode: with reference to FIG. 7, the rear section 32 is reciprocally and longitudinally moved relative to the front section 31 for changing the total length of the stepping device 30 to adjust the elliptical foot motion of the elliptical trainer and a restitution force is provided between the front section 31 and the rear section 32. Consequently, the rear section 32 is backward moved relative to the front section 31 and the total length of the stepping device 30 is lengthen when the user forced step the pedal 33. Accordingly, the long axis of the foot motion of the elliptical trainer in accordance with the preset invention is lengthened. By using the above six bar linkage mechanism, the rear end of the foot motion of the elliptical trainer is raised for enhancing the exercise effect of the user's calfs when the long axis of the foot motion of the elliptical trainer is lengthened. With reference to FIG. 8, the rear section 32 is gradually forward moved relative to the front section 31 when the step force from the operator is gradually weakened after operating the elliptical trainer for a period of time. Accordingly, the long axis of the foot motion of the elliptical trainer in accordance with the preset invention is gradually shortened to gradually reducing the exercise load of the user before stopping the elliptical trainer.

Figure 9:
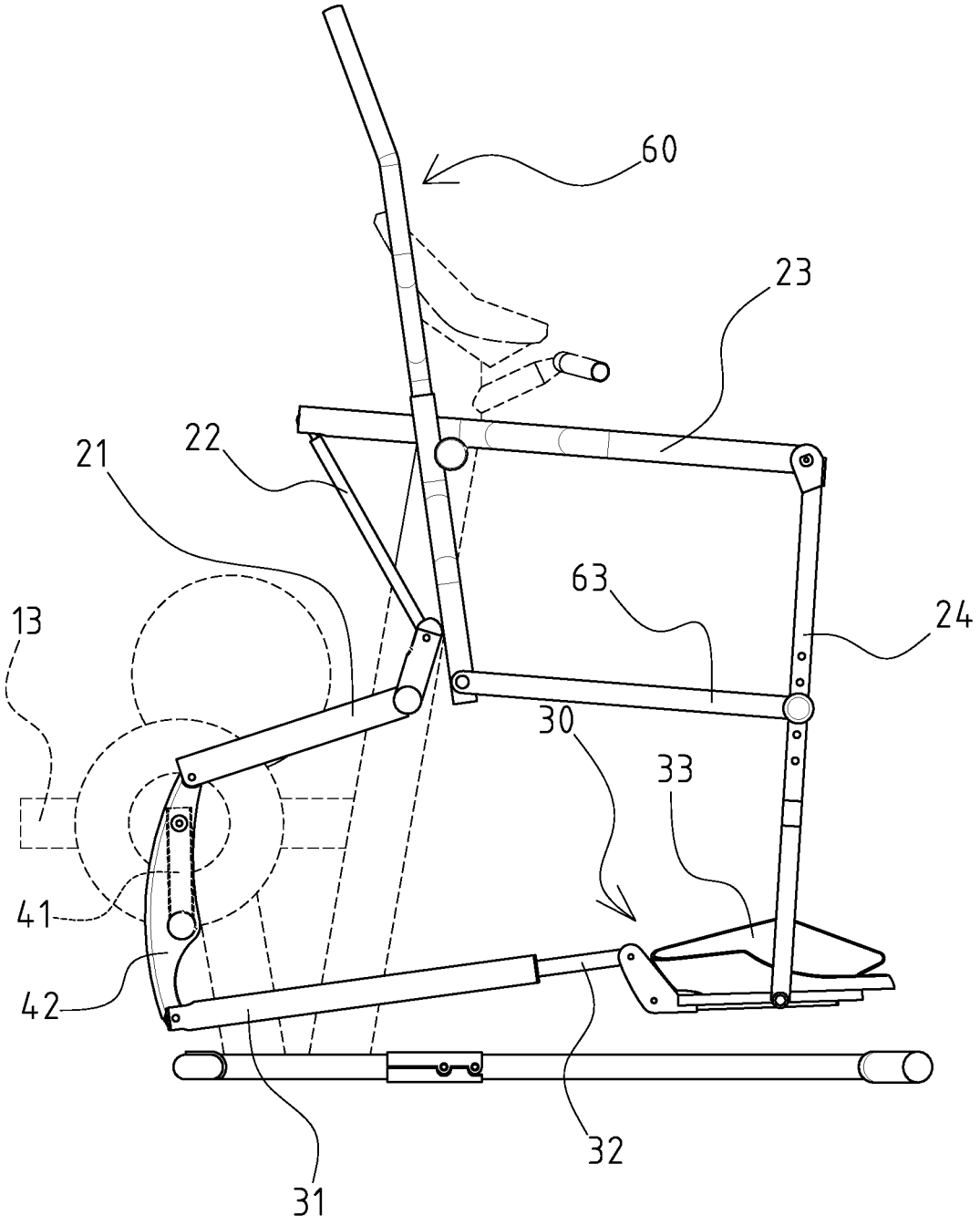
FIG. 9 is side plan view of a second embodiment of the elliptical trainer in accordance with the preset invention.

With reference to FIG. 9 that shows a second embodiment of the present invention, in this preset invention, the lower end of each of the two handlebars 60 is pivotally connected to a first end of a linkage 63 and the linkage 63 of has a second end pivotally connected to a corresponding one of the two third linkage 24 for enhancing the swing range of an upper end of the handlebar 60.

Although the invention has been explained in relation to its preferred embodiment, it is to be understood that many other possible modifications and variations can be made without departing from the spirit and scope of the invention as hereinafter claimed.

I claim:

1. An elliptical trainer comprising:

a main frame having two opposite sides;

a linking device mounted on each of said two opposite sides of said main frame;

a stepping device mounted on each of said two opposite sides of said main frame;

an interlocking device mounted on each of said two opposite sides of said main frame, wherein said interlocking device connects said linking device and said stepping device; and a damping device mounted on said main frame and cooperative with the two interlocking devices so promote exercise on the elliptical trainer, each interlocking device has a crank having a first end secured on a corresponding one of two ends of an axle and a linkage having a middle portion pivotally mounted onto a second end of said crank, wherein the two cranks oppositely extend and linearly correspond to each other, each of the linkages having two opposite ends respectively pivotally connected to a corresponding one of the two linking devices and a corresponding one of the two stepping devices, said linking device having a swing linkage laterally and pivotally mounted onto a stem, said swing linkage having a first end pivotally connected to a first end of the linkage and a second end pivotally connected to a first end of a first linkage, a second linkage laterally and pivotally mounted onto the stem, said second linkage having a front end and a rear end, wherein a front end of the second linkage is pivotally connected to a second end of the first linkage, wherein a third linkage has an upper end pivotally connected to the rear end of the second linkage, the third linkage having a lower end pivotally connected to the corresponding stepping device, the stepping device has a front end and a rear end respectively pivotally connected to a second end of the linkage and the lower end of the third linkage, the stepping device divided into a front section and a rear section linearly strung together, wherein the front end of the front section is pivotally connected to the second end of the linkage, a pedal being pivotally connected to the rear end of the rear section, the lower end of the third linkage laterally and pivotally connected to the pedal, and the rear section reciprocally and longitudinally moves relative to the front section for changing a total length of the corresponding stepping device to adjust a length of a longitudinal axis of elliptical foot motion of the elliptical trainer due to a step force from an operator.

2. The elliptical trainer of claim 1, wherein said main frame includes an I-shaped base, the stem extending from a front portion of the base, and a support connected to the base and the stem, said damping device having a flywheel rotatably mounted on the support by the axle and a damping wheel rotatably mounted on the support, wherein the damping wheel is cooperative with the flywheel so as to promote exercise on the elliptical trainer.

3. The elliptical trainer of claim 2, further comprising:

a pair of handlebars respectively pivotally connected to the two opposite sides of the main frame, wherein each of said pair of handlebars has a lower end pivotally connected to the front end of a corresponding one of the stepping devices and an upper end that is adapted to be handled by the operator.

4. The elliptical trainer of claim 3, wherein each of said pair of handlebars has an inner tube and an outer tube, the inner tube partially and movably received in the outer tube such that a total length of each of said pair of handlebars is changed due to the longitudinal axis of elliptical foot motion of the elliptical trainer.

5. The elliptical trainer of claim 4, wherein the front section and the rear section of said stepping device are assembled as a cylinder.

6. The elliptical trainer of claim 2, further comprising:

a pair of handlebars respectively pivotally connected to the two opposite sides of said main frame, wherein a lower end of each of the pair of handlebars is pivotally connected to a first end of another linkage and the another linkage has a second end pivotally connected to a corresponding one of the third linkages so as to enhance a swing range of an upper end of the corresponding handlebar.

7. The elliptical trainer of claim 6, wherein the front section and the rear section of said stepping device are assembled as a cylinder.

8. The elliptical trainer of claim 1, further comprising:

a pair of handlebars respectively pivotally connected to the two opposite sides of said main frame, wherein each of said pair of handlebars has a lower end pivotally connected to the front end of a corresponding one of the stepping devices and an upper end that is adapted to be handled by the operator.

9. The elliptical trainer of claim 8, wherein each of said pair of handlebars has an inner tube and an outer tube, the inner tube being partially and movably received in the outer tube such that a total length of each of said pair of handlebars is changed due to the longitudinal axis of the elliptical foot motion of the elliptical trainer.

10. The elliptical trainer of claim 9, wherein the front section and the rear section of said stepping device are assembled as a cylinder.

11. The elliptical trainer of claim 1, further comprising:

a pair of handlebars respectively pivotally connected to the two opposite sides of said main frame, wherein a lower end of each of said pair of handlebars is pivotally connected to a first end of another linkage and the another linkage has a second end pivotally connected to a corresponding one of the third linkages so as to enhance a swing range of an upper end of the corresponding handlebar.

12. The elliptical trainer of claim 11, wherein the front section and the rear section of said stepping device are assembled as a cylinder.

* * * * *